United States Patent [19]

Alperin

[11] Patent Number: 4,910,899

[45] Date of Patent: Mar. 27, 1990

[54] POP-UP

[76] Inventor: Arthur Alperin, 89 Blair Rd., Holbrook, Mass. 02343

[21] Appl. No.: 219,479

[22] Filed: Jul. 15, 1988

[51] Int. Cl.[4] ..... G09F 1/08

[52] U.S. Cl. ..... 40/539; 40/124.1; 446/148

[58] Field of Search ..... 40/124.1, 539, 610; 446/147, 148, 149, 150; 248/152, 174, 459; 40/610

[56] References Cited

U.S. PATENT DOCUMENTS 1,670,464 5/1928 Marsh ..... 40/124.1
2,458,879 11/1949 Schenk ..... 446/148
2,604,729 7/1952 O'Hara ..... 446/149

FOREIGN PATENT DOCUMENTS 436053 6/1948 Italy ..... 40/124.1
824004 11/1959 United Kingdom ..... 40/124.1

*Primary Examiner*—Cary E. Stone
*Attorney, Agent, or Firm*—Wolf, Greenfield & Sacks

[57] ABSTRACT

This invention is directed at a three piece pop-up adapted to be folded together for mounting in a periodical or the like and having a support portion which can be adapted to provide a free standing decorative piece. The showing surface of the pop-up can have a reproduced scene positioned thereon.

1 Claim, 2 Drawing Sheets

POP-UP

BACKGROUND OF THE INVENTION

This invention relates generally to a means of displaying a scene, photograph, advertisement or graphic either as a pop-up in a periodical or as a free standing display.

SUMMARY OF THE INVENTION

The invention disclosed herein comprises a pop-up having a first end portion, an intermediate portion, a second end portion and an engagement means The engagement means connects the first end portion and the second end portion The intermediate portion is positioned between the first end portion and the second end portion whereby the first end portion, the intermediate portion and the second end portion can be folded together.

A second engagement means connects the first end portion and the intermediate portion and a fourth attachment element is attached to the back surface of the first end portion and to the rear surface of the intermediate portion.

BRIEF DESCRIPTION OF THE DRAWINGS

Further details are explained below with the help of the example(s) illustrated in the attached drawings in which.

DESCRIPTION OF THE PREFERRED EMBODIMENT(S)

Figure 1:
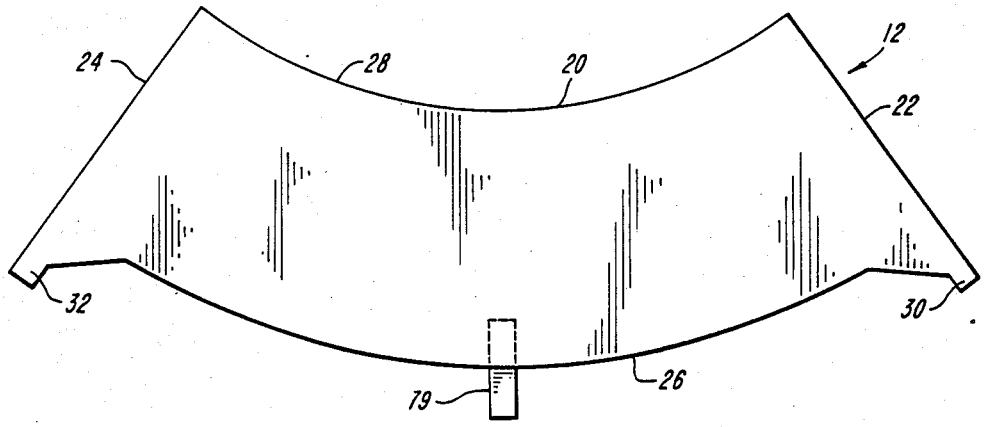
FIG. 1 is a plan view of the end portion of the Pop-up according to the present invention.

There is shown in the drawings a pop-up 10 comprising a first end portion 12, an intermediate portion 14, a second end portion 16 and engagement means or easel 18. The first end portion 12 has a back surface 20, a first side edge 22, a second side edge 24, a first long side edge 26 and a second long side edge 28. The first long side edge 26 has a rectangular first tab 30 extending therefrom adjacent the first side edge 22 and a rectangular second tab 32 extending from the first long side edge 26 adjacent the second side edge 24. The first and second long side edges 26, 28 are in arced, spaced parallel relation to each other as shown in FIG. 1 and the first and second side edges 22, 24 are in spaced angular relation to each other. The first and second tabs 30, 32 are each connected to the first long side edge 26 by a straight edge as shown in FIG. 1.

Figure 3:
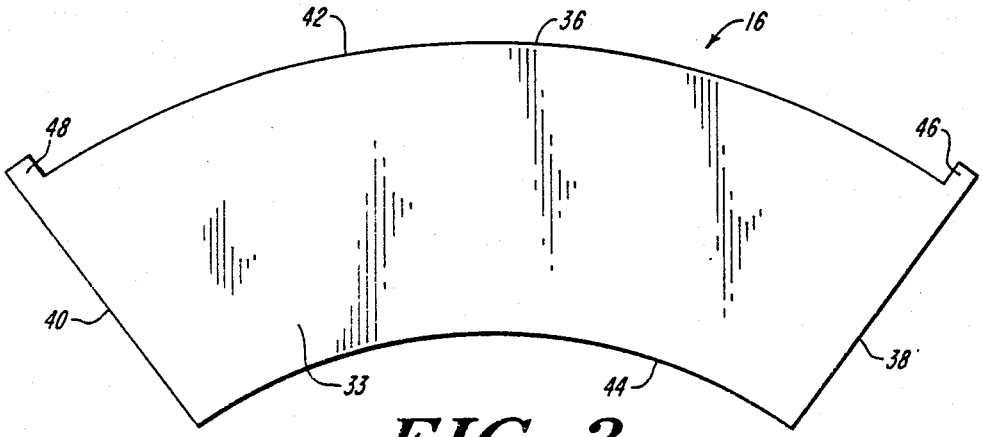
FIG. 3 is a plan view of the second end portion of the Pop-up according to the present invention.
Figure 4:
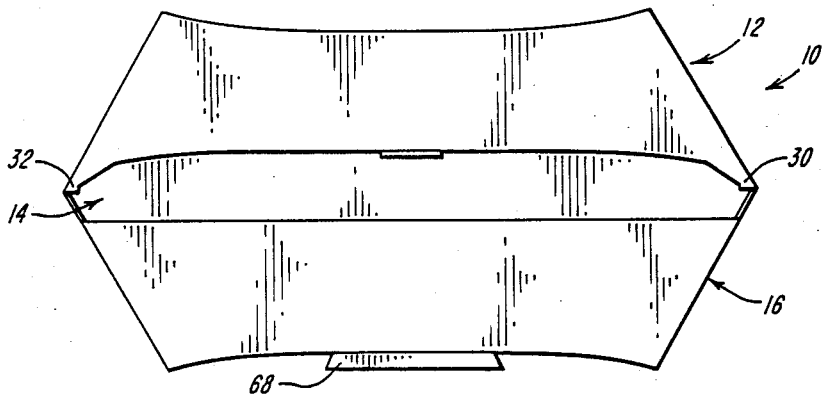
FIG. 4 is a front elevational view, of the Pop-up according to the present invention.
Figure 5:
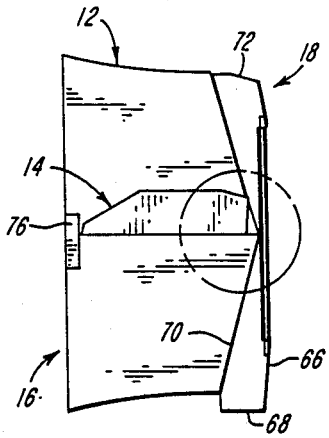
FIG. 5 is a side elevational view, of the Pop-up shown in FIG. 4.
Figure 7:
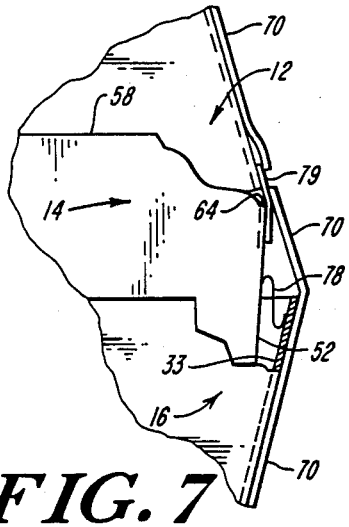
FIG. 7 is an enlarged view of a portion of the Pop-up shown in FIG. 4.

The second end portion 16 has a foresurface 33, a post surface 36, a primary side edge 38, a secondary side edge 40, a primary long side edge 42 and a secondary long side edge 44. The primary long side edge 42 has a rectangular primary tab 46 extending therefrom adjacent the primary side edge 38 and a rectangular secondary tab 48 extending from the primary long side edge 42 adjacent the secondary side edge 40. The primary and secondary long side edges 42, 44 are in arced, spaced parallel relation to each other as shown in FIG. 3 and the primary and secondary side edges 38, 40 are in spaced angular relation to each other. The primary and secondary tabs 46, 48 are each connected to the primary long side edge 42 as shown in FIG. 3.

Figure 2:
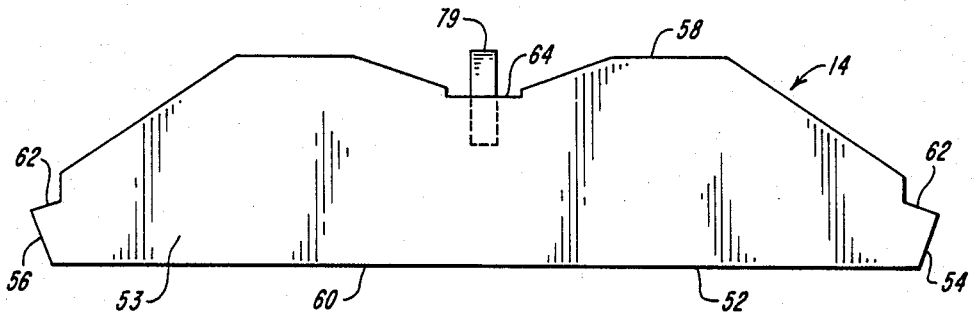
FIG. 2 is a plan view of the intermediate portion of the Pop-up according to the present invention.

The intermediate portion 14 has a rear surface 52, a front surface 53, a right side edge 54, a left side edge 56, a front long side edge 58 and a rear long side edge 60. The right and left side edges 54, 56 are each stepped to provide a shoulder portion 62. A rectangular notch 64 is centrally formed in the front long side edge 58 and portions of the front long side edge 58, on each side of the notch 64, are cut at an angle to the shoulder 62, as shown in FIG. 2. The front and rear long side edges 58, 60 are in substantially parallel relation to each other as shown in FIG. 2 and the right and left side edges 54, 56 are in spaced angular relation to each other. The first end portion 12, the intermediate portion 14 and the second end portion 16 may be formed of a thin plastic, Mylar for example.

The engagement means 18 includes a triangular shaped support portion 66 having an integral flap 68 extending from the triangular shaped support portion 66. The flap 68 is also integral with the attachment portion 70 which has a similar configuration to that of the support portion 66. The flap 68 connects the support portion 66 to the attachment portion 70 at one end and the support and attachment portions 66, 70 are connected together through an integral second flap 72 at the other end. The support portion 66 includes a pair of transverse through slots 74 that are in spaced parallel relation to each other for a purpose to be set forth hereinafter. The support and attachment portions 66, 70 are in spaced, angular relation to each other.

Figure 6:
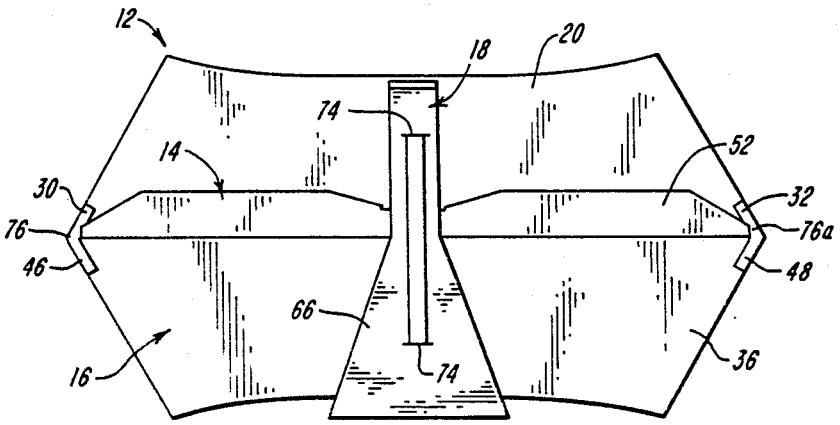
FIG. 6 is a rear elevational view, of the Pop-up shown in FIG. 4.

The first end portion 12, the intermediate portion 14, the second end portion 16 and the engagement means 18 are associated together to form the pop-up 10. The intermediate portion 14 is positioned between the first end portion 12 and the second end portion 16. The first and second tabs 30, 32 and the first long side edge 26 of the first end portion 12 are positioned proximate the front surface 53 and the front long side edge 58 of the intermediate portion 14 and the primary and secondary tabs 46, 48 and the primary long side edge 42 of the second end portion 16 are positioned proximate the rear surface 52 and the rear long side edge 60 of the intermediate portion 14. A first attachment element 76 formed of adhesive tape is adhered to the back surface 20 of the first tab 30 of the first end portion 12 then across the intermediate portion 14 without adherence and is then adhered to the post surface 36 of the primary tab 46 of the second end portion 16. A second attachment element **76*a* formed of adhesive tape is adhered to the back surface 20 of the second tab 32 of the first end portion 12 then across the intermediate portion 14 without adherence and is then adhered to the post surface 36 of the secondary tab 48 of the second end portion 16. The relation ship of the tabs to first and second attachment elements 76 is shown in FIG. 6. The engagement means 18 is attached to the assembled first end portion 12 and the second end portion 16 by adhering the triangular like portion of the attachment portion 70 to the transverse midline of the back surface 20 of the first end portion 12 and the transverse midline of the post surface 36 of the second end portion 16 while a looped flexible third attachment element 78 is attached to the rear surface 52 of the intermediate portion 14 and the foresurface 33 of the end portion 16. The shank portion of the attachment portion 70 extends through the notch 64 formed in the front long side edge 58 of the intermediate portion 14. A fourth attachment element 79 formed of adhesive tape is adhered to the back surface 20 of the first end portion 12 and then onto the rear surface 52 of the intermediate portion 14 adjacent the notch 64 formed in its front long side edge 58**.

The assembled pop-up 10 can be folded into a comparatively flat package with the flaps 68, 72 folded transversely and outwardly, the support portion 66 butted against the attachment portion 70, the rear surface 52 of the intermediate portion 14 butted against the second end portion 16 and the first end portion 12 butted against the front surface 53 of the intermediate portion 14. To open the pop-up 10, from the flattened position the first end portion 16 is rotated away from the intermediate portion 14 creating a generally hemispherical or bowl-like configuration. The hemispherical configuration is provided by the relationship of the first end portion 12, intermediate portion 14 and the second end portion 16 and the fact that the first and second long side edges 26, 28 of the first end portion 12 and the primary and secondary long side edges 42, 44 of the second end portion 16 are arced.

The pop-up 10 can be adhered to two facing pages of a periodical or the like by adhering the triangular-like portion of the support portion 66 of the engagement means 18 to one page and the shank portion of the support portion 66 of the engagement means 18 to the facing page. When the periodical is open to the appropriate pages, the first end portion 12 is rotated away from the intermedite portion 14 creating the mentioned hemispherical or bowl-like configuration. The showing surfaces of the pop-up 10 can have a reproduced scene, photograph or an advertisement or graphic. The pop-up can be removed from the periodical and by inserting a straight support into both slots 74 can provide a free standing decorative piece exhibiting the reproduced scene, photograph, advertisement or graphic.

What I claim is:

1. A pop-up comprising a first end portion, an intermediate portion, a second end portion and an engagement means, the engagement means connecting the first end portion and the second end portion, the intermediate portion positioned between the first end portion and the second end portion whereby the first end portion, the intermediate portion and the second end portion can be folded together, wherein, the first end portion has a first long side edge, a first side edge and a second side edge, the intermediate portion having first and second shoulder portions, and the second end portion has a primary long side edge, a primary side edge and a secondary side edge, the first long side edge has a first tab extending therefrom adjacent the first side edge and a second tab extending from the first long side edge adjacent the second side edge, the primary long side edge has a primary tab extending therefrom adjacent the primary side edge and a secondary tab extending from the primary long side edge adjacent the secondary side edge, the intermediate portion has a rear surface, the first and second tabs positioned in abutting relation to the first and second shoulder portions of the intermediate portion and the primary and secondary tabs positioned in abutting relation to the rear surface of the intermediate portion.

* * * * *

UNITED STATES PATENT AND TRADEMARK OFFICE

CERTIFICATE OF CORRECTION

PATENT NO. : 4,910,899

DATED : March 27, 1990

INVENTOR(S) : Alperin

It is certified that error appears in the above—identified patent and that said Letters Patent is hereby corrected as shown below:

Col. 1, line 30 - after "the" first instance, insert -- first --.

Col. 1, line 63 - change "foresurface" to -- fore surface --.

Col. 2, line 62 - change "relation ship" to -- relationship --.

Col. 2, line 63 - after "76" insert -- , 762 --.

Col. 2, line 65 - after "triangular" insert -- - --.

Col. 3, line 3 - change "foresurface" to -- fore surface --.

Col. 3, line 4 - after "the" first instance, add -- second --.

Col. 3, line 20 - change "16" to -- 12 --.

Signed and Sealed this

Ninth Day of July, 1991

*Attest:*

*Attesting Officer*

HARRY F. MANBECK, JR.

*Commissioner of Patents and Trademarks*